United States Patent [19]

Nittel et al.

[11] Patent Number: 4,906,560

[45] Date of Patent: Mar. 6, 1990

[54] PHOTOGRAPHIC MATERIAL

[75] Inventors: Fritz Nittel; Wolfgang Himmelmann, both of Leverkusen; Rudolf Tromnau, Cologne; Erich Müller, Leverkusen, all of Fed. Rep. of Germany

[73] Assignee: Agfa-Gevaert Aktiengesellschaft, Leverkusen, Fed. Rep. of Germany

[21] Appl. No.: 255,714

[22] Filed: Oct. 11, 1988

[30] Foreign Application Priority Data

Oct. 21, 1987 [DE] Fed. Rep. of Germany ..... 3735586

[51] Int. Cl.[4] ..... G03C 1/74

[52] U.S. Cl. ..... 430/637; 430/536; 430/537; 430/538; 430/539; 430/621; 430/935

[58] Field of Search ..... 430/637, 538, 539, 536, 430/537, 621, 935

[56] References Cited

U.S. PATENT DOCUMENTS

| | | | |
|---|---|---|---|
| 3,791,857 | 2/1974 | Balle et al. | 430/537 |
| 4,399,214 | 8/1983 | Lohmer | 430/532 |
| 4,572,893 | 2/1986 | Asao | 430/538 |
| 4,762,776 | 8/1988 | Uesawa et al. | 430/637 |

*Primary Examiner*—Paul R. Michl
*Assistant Examiner*—Thorl Chea
*Attorney, Agent, or Firm*—Connolly & Hutz

[57] ABSTRACT

In order to be able to cast additional layers on auxiliary layers of photographic materials immediately after the latter have been cast without encountering any difficulties as regards uniformity of the cast layer and wet adherence due to incomplete conversion of the gelatine from the sol to the gel form, the auxiliary layer must contain an effective quantity of at least one compound obtained by the reaction of trihydric to hexahydric alcohols with propylene oxide.

6 Claims, No Drawings

PHOTOGRAPHIC MATERIAL

This invention relates to a photographic material which can be prepared by a more rational method and contains at least one auxiliary layer and at least one light sensitive emulsion layer.

It is known to draw a gelatine layer (substrate layer) over polyethylene coated paper. After a corona discharge treatment, the layers are applied wet in quantities of 3 to 8 g/m$^2$ by means of a coating knife or roller and dried. The amount of layer when dry is from 100 to 400 mg/m$^2$.

Coating with the substrate layer which contains gelatine is generally combined with PE extrusion and application of an antistatic layer.

A separate application of the substrate layer would cause considerable difficulties (soiling) since the pure PE layer running through the machine acquires a powerful static charge and attracts particles of dust and dirt.

Casting of the substrate layer which is carried out together with PE extrusion and corona irradiation takes place at high speed (about 100 to 130 m/min) so that the substrate layer which is applied in a low quantity as wet layer dries so rapidly that the gelatine is present in pure sol form with a melting point of 8° to 12° C.

The application of additional layers to this substrate layer leads to considerable difficulties. The smooth material is found to contain curtain like structures which are due to the substrate layer partly melting and slipping. The wet adherence is also found to be seriously impaired when such a material is processed.

In practice this means that freshly cast substrate layers cannot in turn be coated immediately after casting.

These difficulties may be overcome by waiting until the gelatine in the substrate layer has been converted from the sol to the gel form. This is a reaction which requires a certain minimum length of time and the supply of moisture and is achieved either by rolling the layer over at a sufficiently high moisture content (60 to 70% relative humidity) or by an equalization with the internal moisture of the raw material. Even then, sol/-gel conversion will not always take place uniformly over the whole width of the material. An additional difficulty and expense is the need to provide temporary storage.

It is a special object of the present invention to provide a photographic material for viewing by reflected light comprising a substrate layer and at least one light sensitive layer in which at least this one light sensitive layer can be cast immediately after application and drying of the substrate layer.

In general terms, the problem consists of providing photographic materials containing at least one auxiliary layer and at least one light sensitive layer which have improved properties and/or can be prepared more rationally.

It was a particular object of this invention to provide a photographic material containing at least one auxiliary layer and at least one light sensitive emulsion layer in the preparation of which the application and drying of the auxiliary layer can be immediately followed by the application of the other layers.

The auxiliary layer may consist of the substrate layer on which other layers may be cast but it may also be a NC layer, i.e. a layer applied to the back of the substrate to prevent curling of the material, or it may consist of the uppermost protective layer which is applied to the substrate after application of the light sensitive layers.

The auxiliary layer is preferably the substrate layer, in particular in polyethylene coated paper.

It has now been found that the above mentioned difficulties may be overcome if the auxiliary layer contains, as binder, at least one compound obtained by the reaction of a trihydric to hexahydric alcohol with propylene oxide (PO).

The compounds preferably have an OH content of from 7 to 15% by weight, in particular from 9.5 to 12.5% by weight (weight of the OH groups based on the total weight of the molecule). This corresponds to a reaction with 4 to 10 mol of propylene oxide, depending on the molecular weight of the trihydric to hexahydric alcohol, random distribution being obtained over all the molecules.

The number of carbon atoms in the tri- to hexa-hydric alcohols is preferably from 3 to 6. Examples include glycerol, trimethylol propane, hexane triols, pentaerythritol and sorbitol.

The following are specific examples of compounds:

| | % by weight OH |
|---|---|
| 1. Glycerol + 4 PO | 15.69 |
| 2. Glycerol + 5 PO | 13.32 |
| 3. Glycerol + 5.5 PO | 12.40 |
| 4. Glycerol + 5.75 PO | 11.97 |
| 6. Glycerol + 6.25 PO | 11.21 |
| 7. Glycerol + 6.5 PO | 10.87 |
| 8. Glycerol + 7 PO | 10.22 |
| 9. Glycerol + 8 PO | 9.17 |
| 10. Glycerol + 10 PO | 7.59 |
| 11. 1,1,1-trimethylol propane + 4 PO | 13.93 |
| 12. 1,1,1-trimethylol propane + 5 PO | 12.02 |
| 13. 1,1,1-trimethylol propane + 5.25 PO | 11.61 |
| 14. 1,1,1-trimethylol propane + 5.5 PO | 11.25 |
| 15. 1,1,1-trimethylol propane + 6 PO | 10.58 |
| 16. 1,1,1-trimethylol propane + 6.5 PO | 10.00 |
| 17. 1,1,1-trimethylol propane + 7 PO | 9.44 |
| 18. 1,1,1-trimethylol propane + 8 PO | 8.53 |
| 19. 1,1,1-trimethylol propane + 9 PO | 7.77 |
| 20. 1,1,1-trimethylol ethane + 4 PO | 14.48 |
| 21. 1,1,1-trimethylol ethane + 5 PO | 12.43 |
| 22. 1,1,1-trimethylol ethane + 5.5 PO | 11.61 |
| 23. 1,1,1-trimethylol ethane + 5.75 PO | 11.23 |
| 24. 1,1,1-trimethylol ethane + 6 PO | 10.89 |
| 25. 1,1,1-trimethylol ethane + 7 PO | 9.69 |
| 26. 1,1,1-trimethylol ethane + 9 PO | 7.94 |
| 27. 1,2,6-hexane triol + 4 PO | 13.97 |
| 28. 1,2,6-hexane triol + 5 PO | 12.05 |
| 29. 1,2,6-hexane triol + 5.25 PO | 11.64 |
| 30. 1,2,6-hexane triol + 5.5 PO | 11.28 |
| 31. 1,2,6-hexane triol + 6 PO | 10.60 |
| 32. 1,2,6-hexane triol + 7 PO | 9.46 |
| 33. pentaerythritol + 7 PO | 12.54 |
| 34. Pentaerythritol + 7.5 PO | 11.90 |
| 35. Pentaerythritol + 8 PO | 11.30 |
| 36. Pentaerythritol + 8.5 PO | 10.81 |
| 37. Pentaerythritol + 10 PO | 9.50 |
| 38. Sorbitol + 11 PO | 12.43 |
| 39. Sorbitol + 12 PO | 11.62 |
| 40. Sorbitol + 14 PO | 10.26 |

The reaction products of the tri- to hexahydric alcohols with propylene oxide are used in particular in combination with gelatine in a ratio by weight of reaction product to gelatine of from 0.1:1 to 10:1. The reaction product may also be used without gelatine as binder.

Gelatine may be used in the pure form or in combination with other high molecular weight water soluble substances, e.g. polyvinyl pyrrolidone or copolymers of vinyl pyrrolidone and vinyl acetate, the ratio by weight of reaction product to gelatine referring to the sum of gelatine and water soluble high molecular weight polymer.

The compounds according to the invention may be used as follows:

1. Combination with a large quantity of gelatine:

Addition of 0.25 to 1 parts by weight of the compound according to the invention to 1 part by weight of gelatine. The gelatine used should have a high gel strength (>200). The wetting agents used are anionic compounds, preferably compounds which are both water soluble and oil soluble, such as sulphosuccinic aciddi-(2-ethylhexyl)-ester, dodecylbenzene sulphonate, etc.

When the compounds are used in this form, a layer melting point corresponding to that of the pure gel form of gelatine (30° C.) is obtained even with rapid drying.

This result is surprising since it is known of polyethylene glycols having a similar structure that they reduce the amount of heat required for destroying the gel structure and thereby favour the transition from the gel to the sol phase and not conversely (Nikolaus Schönfeldt, Grenzflächenaktive Äthylenoxid-Addukte, Supplement 1984, Wissenschaftliche Verlagsgesellschaft mbH Stuttgart, pages 60/61 and 172).

In contrast to other known polyalkylene glycols used in emulsion layers, the compounds according to the invention manifest no photographic activity. They are also free from any of the characteristics of wetting agents.

A detailed description of the use of polyethylene oxide adducts in photography with numerous literature references is given by Nikolaus Schönfeldt, Grenzflächenaktive Äthylenoxide-Addukte, Wissenschaftliche Verlagsgesellschaft mbH Stuttgart, 1976, pages 826–829. These products are proposed for sensitizing photographic emulsions or for use as wetting agents. Neither of these applications has anything to do with the problem according to the invention of rapid conversion of the sol form into the gel form.

The dry application of the layers described above is preferably from 80 to 500 mg/m$^2$.

The pH of the gelatine may be in the range from slightly acid to slightly alkaline.

2. Combination with a small quantity of gelatine:

Addition of 2 to 8 parts by weight of the compound according to the invention to 1 part by weight of gelatine. Wetting agent: anionic as under 1. When used in this form, layers with high melting points are not obtained, and the dry application must therefore also be considerably lower, preferably from 50 to 120 mg/m$^2$. The advantage of these layers lies in the excellent casting properties of the compositions, the cast material being much more uniform in the medium density range than a cast layer of pure polyethylene. The wet adherence sets in after 3 to 4 days which is similar to the time required when casting a pure PE layer.

3. Use of the compounds according to the invention without gelatine:

It is surprisingly found that the compounds according to the invention may also be used as binders in substrate layers which are free from gelatine. The same anionic compounds as those used for 1 are used as wetting agents at low concentrations (1 to 2% by weight, based on the substance). The dry application is preferably from 50 to 120 mg/m$^2$, an application of 50 mg/m$^2$ being sufficient to produce a layer which lowers the specific surface resistance from $>10^{14}$ Ω/cm of pure PE to $1\times10^{10}$ Ω/cm and hence also considerably reduces the electrostatic charge of the PE layer and its tendency to attract dirt. When other layers are subsequently cast to produce a colour photographic arrangement and the layers are exposed and processed, the uniformity of coloured areas of medium density are better than those obtained when the pure PE layer is cast. The wet adherence sets in after 3 to 4 days which is much the same as the time required when casting pure PE.

4. Gelatine free use in combination with antistatic agents:

A further improvement in the conductivity of the substrate layer may be obtained by a combination with antistatic agents. When the same dry application is used as under 3, conductivity of $1\times10^9$ Ω/cm are obtained by a combination with polystyrene sulphonic acid or low molecular weight acrylic acids. These combinations preferably consist of 50 to 75% by weight of compounds according to the invention and 50 to 25% by weight of antistatic agents. The optimum quantity for enabling the layers to be covered by other layers is determined by experiments. When pure antistatic agents alone are used, faults in casting occur.

5. Combination with gelatine and conventional hardeners:

The addition of 0.3 to 0.6 parts by weight of the compound according to the invention to 1 part by weight of gelatine. Whereas only weak hardeners such as chrome alum are used in substrate layers so that the subsequent layers can be cast on them smoothly, rapid and substantially complete hardening is important for the much thicker NC layers. By rapidly restructuring the gelatine, the compounds according to the invention in this case enable conventional hardeners such as triacrylic formal (tris-(N,N',N''-acryloyl)-s-hydrotriazine) to act rapidly whereas they would be virtually incapable of completely hardening the sol form of gelatine.

The following are examples of conventional hardeners: activated vinyl compounds such as divinyl sulphone, N,N'-ethylene-bis-(vinylsulphonylacetamide), 1,3-bis-(vinylsulphonyl)-2-propanol, methylenebismaleimide, 5-acetyl-1,3-diacryloyl-hexahydro-S-triazine, 1,3,5-triacryloylhexahydro-S-triazine and 1,3,5-trivinylsulphonyl-hexahydro-S-triazine; activated halogen compounds such as 2,4-dichloro-6-hydroxy-S-triazine, sodium salt, 2,4-dichloro-6-methoxy-S-triazine, 2,4-dichloro-6-(4-sulpho-anilino)-S-triazine, sodium salt, 2,4-dichloro-6-(2-sulphoethylamino)-S-triazine and N,N-bis-(2-chloroethylcarbamoyl)-piperazine;

Epoxide compounds such as bis-(2,3-epoxipropyl)-methylpropylammonium-p-toluene sulphonate, 1,4-bis-(2',3'-epoxipropyloxy)-butane, 1,3,5-triglycidylisocyanurate and 1,3-diglycyl-4-(γ-acetoxy-β-oxypropyl)-isocyanurate; Ethylene imino compounds such as 2,4,6-triethylene-S-triazine, 1,6-hexamethylene-N,N'-bis-ethylene urea and bis-β-ethylene iminoethylthio ether;

Methane sulphonic acid ester compounds such as 1,2-di-(methane sulphonoxy)-ethane, 1,4-di-(methane sulphonoxy)-butane and 1,5-di-(methane sulphonoxy)-pentane;

Inorganic hardeners such as chrome alum, chrome sulphate, aluminium sulphate, potash alum and aluminium chloride.

6. Combination with gelatine and instant hardeners.

Photographic layers are generally dried under much milder conditions after casting than the auxiliary layers used for the photographic support and yet the layers containing gelatine will not be obtained entirely in their gel form after casting; nor is this necessary when conventional hardeners are used since in the presence of a suitable moisture level with which to reach equilibrium, the sol/gel conversion takes place within the first 2 days while the hardening reaction is in most cases prolonged over an even longer period. The situation is different in instant hardening. In that case, sol components and gel components are hardened instantly immediately after drying and the physical nature varies with each portion of gel/sol inspite of the high melting point. This manifests itself mainly in the wet scratch resistance and the dry scratch resistance.

It has now been found that the above mentioned two properties may be substantially improved by using the compound according to the invention in the protective layer cast at the top. The concentration of compounds according to the invention used for this purpose is preferably 0.5 parts by weight to 1 part by weight of gelatine.

Instant hardeners are understood to be compounds which are capable of cross-linking suitable binders at such a rate that hardening is sufficiently completed immediately after casting or at latest after 24 hours, preferably after not more than 8 hours, so that no further change in sensitometry or swelling of the combination of layers can occur as the result of the cross-linking reaction. By "swelling" is meant the difference between the wet layer thickness and the dry layer thickness when a film is processed under aqueous conditions (Photogr. Sci. Eng. 8 (1964), 275; Photogr. Sci. Eng. (1972), 449).

These hardeners which react very rapidly with gelatine include, for example, carbamoyl pyridinium salts which are capable or reacting with free carboxyl groups of gelatine so that these react with free amino groups of gelatine to form peptide bonds and bring about cross-linking of gelatine.

Examples of suitable instant hardeners include compounds corresponding to the following general formulae:

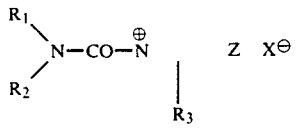

(a)

wherein $R_1$ denotes alkyl, aryl or aralkyl, $R_2$ has the same meaning as $R_1$ or denotes alkylene, arylene, aralkylene or alkaralkylene in which the second bond is attached to a group of the formula

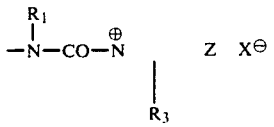

or $R_1$ and $R_2$ together denote the atoms required for completing an optionally substituted heterocyclic ring, for example a piperidine, piperazine or morpholine ring, which ring may be substituted, for example by $C_1$ to $C_3$ alkyl or by halogen, $R_3$ denotes hydrogen, alkyl, aryl, alkoxy, $—NR_4—COR_5$, $—(CH_2)_m—NR_8R_9$, $—(CH_2)_n—CONR_{13}R_{14}$ or $$—(CH_2)_p—\underset{\underset{R_{15}}{|}}{CH}—Y—R_{16}$$

or a bridging member or a direct bond on a polymer chain, and $R_4$, $R_6$, $R_9$, $R_{14}$, $R_{15}$, $R_{17}$, $R_{18}$ and $R_{19}$ denote hydrogen or $C_1$ to $C_4$ alkyl, $R_5$ denotes hydrogen, $C_1$ to $C_4$ alkyl or $NR_6R_7$, $R_8$ denotes $—COR_{10}$, $R_{10}$ denotes $NR_{11}R_{12}$, $R_{11}$ denotes $C_1$ to $C_4$ alkyl or aryl, in particular phenyl, $R_{12}$ denotes hydrogen, $C_1$ to $C_4$ alkyl or aryl, in particular phenyl, $R_{13}$ denotes hydrogen, $C_1$ to $C_4$ alkyl or aryl, in particular phenyl, $R_{16}$ denotes hydrogen, $C_1$ to $C_4$ alkyl, $COR_{18}$ or $CONHR_{19}$, m denotes a number with a value from 1 to 3, n denotes a number with a value from 0 to 3, p denotes a number with a value from 2 to 3 and Y denotes 0 or $NR_{17}$ or $R_{13}$ and $R_{14}$ together represent the atoms required for completing an optionally substituted heterocyclic ring, for example a piperidine, piperazine or morpholine ring, which ring may be substituted, e.g. by $C_1$ to $C_3$ alkyl or by halogen, Z denotes the carbon atoms required for completing a 5- or 6-membered aromatic, heterocyclic ring, optionally having a condensed benzene ring attached, and $X^{\ominus}$ denotes an anion, which is absent when an anionic group is already attached to the remainder of the molecule;

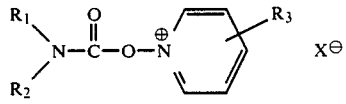

(b)

wherein $R_1$, $R_2$, $R_3$ and $X^{\ominus}$ have the meanings indicated for formula (a).

Silver halide grains are the main light sensitive material used. The light sensitive layers in addition contain a binder. The auxiliary layers also contain binders in addition to other products.

The binder used is preferably gelatine but this may be partly or completely replaced by other synthetic, semi-synthetic or naturally occurring polymers. The following are examples of synthetic gelatine substitutes: polyvinyl alcohol, poly-N-vinylpyrrolidone, polyacrylamides, polyacrylic acid and their derivatives, in particular their copolymers. Naturally occurring gelatine substitutes include, for example, other proteins, such as albumin or casein, cellulose, sugar, starch and alginates; semi-synthetic gelatine substitutes are generally modified natural products. Cellulose derivatives such as hydroxyalkyl cellulose, carboxymethyl cellulose and phthalyl cellulose and gelatine derivatives obtained by a reaction with alkylating or acylating agents or by grafting polymerisable monomers are examples of such products.

The binders should contain a sufficient quantity of functional groups to give rise to sufficiently resistant layers when they react with suitable hardeners. Such functional groups include in particulr amino groups but also carboxyl groups, hydroxyl groups and active methylene groups.

The gelatine used is preferably one which may be obtained by acid or alkaline decomposition. The preparation of such gelatines is described, for example, in The Science and Technology of Gelatine, published by A. G. Ward and A. Courts, Academic Press 1977, page 295 et sec. The gelatine used should always be as free as possible of photographically active impurities (inert gelatine). Gelatines with a high viscosity and low swelling are particularly advantageous.

The silver halide present as light sensitive component in the photographic material may be a chloride, bromide, iodide or mixtures thereof. For example, the halide content of at least one layer may contain from 0 to 15 mol % of iodide, from 0 to 100 mol % of chloride and from 0 to 100 mol % of bromide. It may consist predominantly of compact crystals, e.g. in the form of regular cubes of octahedrons or transitional forms. Platelet shaped crystals may advantageously also be present. These should preferably have an average ratio of diameter to thickness of less than 8:1, the diameter of a grain being defined as the diameter of a circle having the same area as the projected area of the grain. The layers may also contain tabular silver halide crystals in which the ratio of diameter to thickness is greater than 8:1.

The silver halide grains may also have a multilayered grain structure, in the simplest case with an inner and an outer grain region (core/shell) which differ from one another in their halide compositions and/or other modifications, such as doping. The average grain size of the emulsions is preferably from 0.2 μm to 2.0 μm and the grain size distribution may be either homodisperse or heterodisperse. Homodisperse grain distribution means that 95% of the grains deviate by not more than ±30% from the average grain size. The emulsions may also contain organic silver salts in addition to the silver halide, e.g. silver benzotriazolate or silver behenate.

Two or more types of silver halide emulsions prepared separately may be used as mixtures.

The photographic emulsions may be prepared by various methods from soluble silver salts and soluble halides (e.g. P. Glafkides, Chimie et Physique Photographique, Paul Montel, Paris (1967), G. F. Duffin, Photographic Emulsion Chemistry, The Focal Press, London (1966), V. L. Zelikman et al, Making and Coating Photographic Emulsions, The Focal Press, London (1966)).

Precipitation of the silver halide is preferably carried out in the presence of the binder, e.g. gelatine, and may be carried out in an acid, neutral or alkaline pH, preferably with the addition of silver halide complex formers such as, for example, ammonia, thio-ethers, imidazole, ammonium thiocyanate or excess halide. The water soluble silver salts and the halides may be introduced successively by the single jet process or simultaneously by the double jet process of by any combination of the two processes. It is preferably to add them at increasing rates but without exceeding the "critical" feed rate at which new nuclei just fail to be formed. The pAg range during precipitation may vary within wide limits. The so called pAg controlled method is preferably used, in which the pAg is kept constant at a certain value or passed through a predetermined profile during precipitation. Instead of employing the preferred method of precipitation with an excess of halide, so called inverse precipitation with an excess of silver ions may be employed. The silver halide crystals may be grown not only by precipitation but also by physical ripening (Ostwald ripening) in the presence of excess halide and/or silver halide complex forming agents. Growth of the emulsion grains may in fact be brought about predominantly by Ostwald ripening, in which case a fine grained, so called Lippmann emulsion is preferably mixed with a sparingly soluble emulsion and redissolved on the latter.

Salts or complexes of metals such as Cd, Zn, Pb, Tl, Bi, Ir, Rh or Fe may be present during precipitation and/or physical ripening of the silver halide grains.

The precipitation may also be carried out in the presence of sensitizing dyes. Complex forming agents and/or dyes may be rendered inactive at any point in time, e.g. by changing the pH or by an oxidative treatment.

When crystal formation has terminated or at an earlier stage, the soluble salts are removed from the emulsion, e.g. by shredding and washing, by flocculation and washing, by ultra filtration or by means of ion exchangers.

The silver halide emulsion is generally subjected to a chemical sensitization under specified conditions of pH, pAg, temperature and concentration of, gelatine, silver halide and sensitizer until the optimum sensitivity and fog values are obtained. The procedure has been described, for example, by H. Frieser in "Die Grundlagen der Photographischen Prozesse mit Silberhalogeniden" pages 675 to 734, Akademische Verlagsgesellschaft (1968).

Chemical sensitization may be carried out with the addition of compounds of sulphur, selenium or tellurium and/or compounds of metals of the eighth subgroup of the periodic system (e.g. gold, platinum, palladium or iridium) and thiocyanate compounds, surface active compounds such as thioethers or heterocyclic nitrogen compounds (e.g. imidazoles or azaindenes) or spectral sensitizers (described e.g. by F. Hamer in "The Cyanine Dyes and Related Compounds", 1964, and Ullmanns Encyclopadie der technischen Chemie, 4th edition, volume 18, page 431 et sec. and Research Disclosure Number 17643, section III) may be added. Instead of this or in addition, reduction sensitization may be carried out with the addition of reducing agents (tin-II salts, amines, hydrazine derivatives, aminoboranes, silanes or formamidine sulphinic acid) or by the addition of hydrogen or by using a low pAg (e.g. below 5) and/or a high pH (e.g. above 8).

The photographic emulsions may contain compounds for preventing fogging or for stabilizing the photographic function during production, storage or photographic processing.

Azaindenes are particularly suitable, especially tetra and pentaazaindenes, and particularly those which are substituted with hydroxyl or amino groups. Compounds of this type are described e.g. by Birr, Z. Wiss Phot. 47 (1952), pages 2 to 58. Salts of metals such as mercury or cadmium, aromatic sulphonic or sulphinic acids such as benzene sulphinic acid and nitrogen-containing heterocyclic compounds such as nitrobenzimidazole, nitroindazole, (substituted) benzotriazoles or benzothiazolium salts may also be used as antifoggants. Heterocyclic compounds containing mercapto groups are particularly suitable, e.g. mercaptobenzothiazoles, mercaptobenzimidazoles, mercaptotetrazoles, mercaptothiadiazoles and mercaptopyrimidines, these mercaptoazoles optionally containing a water solubilizing group, e.g. a carboxyl group or a sulpho group. Other suitable compounds are published in Research Disclosure Number 17643 (1978), section VI.

The stabilizers may be added to the silver halide emulsions before, during or after ripening. The compounds may, of course, also be added to other photographic layers which are associated with a silver halide layer.

Mixtures of two or more of the above mentioned compounds may be used.

The photographic emulsion layers or other hydrophilic colloid layers of the light sensitive material which has been prepared according to the invention may contain surface active agents for various purposes, such as coating auxiliaries to prevent electric charging, improve slip properties, emulsify the dispersion, prevent adhesion and improve the photographic characteristics (e.g. acceleration of development, high contrast, sensitization, etc.).

The photographic emulsions may be spectrally sensitized by means of methine dyes or other dyes. Cyanine dyes, merocyanine dyes and complex merocyanine dyes are particularly suitable.

Sensitizers may be dispensed with if the intrinsic sensitivity of the silver halide is sufficient for a particular spectral region, as for example the blue sensitivity of silver bromide.

Photographic materials generally contain at least one red sensitive, one green sensitive and one blue sensitive emulsion layer. These emulsion layers have non-diffusible monomeric or polymeric colour couplers associated with them, which couplers may be present in the same layer or in an adjacent layer. Red sensitive layers are generally associated with cyan couplers, green sensitive layers with magenta couplers and blue sensitive layers with yellow couplers.

Colour couplers for the production of the cyan partial colour image are generally couplers of the phenol or α-naphthol series. Suitable examples of these are known in the literature.

Colour couplers for the production of the yellow partial colour image are generally couplers containing an open chain ketomethylene group, in particular couplers of the α-acylacetamide series such as, for example, α-benzoyl acetanilide couplers and α-pivaloyl acetanilide couplers, which are also known from the literature.

Colour couplers for the production of the magenta partial colour image are generally couplers of the 5-pyrazolone series, the indazolone series or the pyrazoloazole series. Many suitable examples of these couplers are described in the literature.

The colour couplers may be 4-equivalent couplers or 2-equivalent couplers. The latter are derived from 4-equivalent couplers in that they contain in the coupling position a substituent which is split off in the coupling reaction. 2-equivalent couplers include both colourless couplers and couplers with an intense colour of their own which disappears in the colour coupling reaction to be replaced by the colour of the image dye produced (masking couplers), as well as white couplers which give rise to substantially colourless products in their reaction with colour developer oxidation products. 2-equivalent couplers also include those which carry in the coupling position a releasable group which is released in the reaction with colour developer oxidation products to develop a particular photographic activity, e.g. as development inhibitor or accelerator, either directly or after one or more further groups have been split off from the original releasable group (e.g. DE-A-27 03 145, DE-A-28 55 697, DE-A-31 05 026 and DE-A-33 19 428). Examples of such 2-equivalent couplers include both the known DIR couplers and DAR and FAR couplers.

Since the DIR, DAR and FAR couplers are important mainly for the particular activity of the group which is released in the coupling reaction and not so much for the colour forming properties of these couplers, couplers of the DIR, DAR or FAR type which give rise to mainly colourless products in the coupling reaction are also suitable (DE-A-1 547 640).

The released group may be a ballast group so that the reaction with colour developer oxidation products gives rise to coupling products which are capable of diffusing or at least have a certain, limited mobility (US-A-4 420 556).

High molecular weight colour couplers are described, for example, in DE-C-1 297 417, DE-A-24 07 569, DE-A-31 48 125, DE-A-32 17 200, DE-A-33 20 079, DE-A-33 24 932, DE-A-33 31 743, DE-A-33 40 376, EP-A-27 284 and US-A-4 080 211. The high molecular weight colour couplers are generally prepared by the polymerisation of ethylenically unsaturated, monomeric colour couplers but they may also be obtained by polyaddition or polycondensation.

Incorporation of the couplers or other compounds in the silver halide emulsion layers may be carried out by first preparing a solution, dispersion or emulsion of the particular compound and then adding this to the casting solution for the particular layer. The choice of suitable solvents or dispersing agents depends on the solubility of the particular compound.

Methods for introducing compounds which are substantially insoluble in water by grinding are described, for example, in DE-A-2 609 741 and DE-A-2 609 742.

Hydrophobic compounds may also be introduced into the casting solution by means of high boiling solvents, so called oil formers. Suitable methods are described, for example, in US-A-2 322 027, US-A-2 801 170, US-A-2 801 171 and EP-A-0 043 037.

Oligomers or polymers, so called polymeric oil formers, may be used instead of high boiling solvents.

The compounds may also be introduced into the casting solution in the form of charged latices; see, for example, DE-A-2 541 230, DE-A-2 541 274, DE-A-2 835 856, EP-A-0 014 921, EP-A-0 069 671, EP-A-0 130 115 and US-A-4 291 113.

Diffusion resistant incorporation of anionic water soluble compounds (e.g. dyes) may also be carried out by means of cationic polymers, so called mordanting polymers.

Examples of suitable oil formers include phthalic acid alkyl esters, phosphoric acid esters, citric acid esters, benzoic acid esters, alkylamides, fatty acid esters and trimesic acid esters.

The colour photographic material typically includes at least one red sensitive emulsion layer, at least one green sensitive emulsion layer and at least one blue sensitive emulsion layer on a support. The sequence of these layers may be varied as desired. Couplers forming cyan, magenta and yellow dyes are generally incorporated in the red, green and blue sensitive emulsion layers but different combinations may also be used.

Each of the light sensitive layers may consist of a single layer or it may contain two or more silver halide emulsion partial layers (DE-C-1 121 470). In such arrangements, red sensitive silver halide emulsion layers are frequently arranged closer to the layer support than green sensitive silver halide emulsion layers which in turn are arranged closer to the support than blue sensitive layers, and a light insensitive yellow filter layer is generally arranged between the green sensitive layers and the blue sensitive layers.

If the intrinsic sensitivity of the green sensitive or red sensitive layers is sufficiently low, the yellow filter layer may be dispensed with and other layer arrangements employed in which, for example, the blue sensitive layer is placed on the support, followed by the red sensitive layers and finally the green sensitive layers.

The light insensitive inter layers generally placed between layers differing in their spectral sensitivity may contain means for preventing unwanted diffusion of developer oxidation products from one light sensitive layer into another light sensitive layer which has a different spectral sensitization.

If several partial layers of the same spectral sensitization are present, these may differ in their composition, in particular in the nature and quantity of the silver halide grains. The partial layer having the higher sensitivity is generally arranged further away from the support than the partial layer of lower sensitivity. Partial layers of the same spectral sensitization may be arranged adjacent to one another or they may be separated by other layers, e.g. by layers of a different spectral sensitization. Thus, for example, all highly sensitive layers and all low sensitive layers, respectively, may be combined to form a layer packet (DE-A 1 958 709, DE-A 2 530 645 and DE-A 2 622 922).

The photographic material may also contain UV light absorbent compounds, white toners, spacers, filter dyes, formalin acceptors and others. Compounds which absorb UV light are used to protect the image dyes against being bleached by daylight which has a high UV content and they are also used as filter dyes to absorb the UV light of daylight used for exposure and thus improve the colour reproduction of the film. The compounds used for these two different purposes generally have a different structure. Examples include aryl-substituted benzotriazole compounds (US-A 3 533 794), 4-thiazolidone compounds (US-A 3 314 794 and 3 352 681), benzophenone compounds (JP-A 2784/71), cinnamic acid ester compounds (US-A 3 705 805 and 3 707 375), butadiene compounds (US-A 4 045 229) and benzoxazole compounds (US-A 3 700 455).

Ultraviolet absorbent couplers (such as cyan couplers of the α-naphthol series) and ultraviolet absorbent polymers may also be used. These ultraviolet absorbents may be fixed in a particular layer by mordants.

Filter dyes for visible light include compounds such as oxonole dyes, hemioxonole dyes, styrene dyes, merocyanine dyes, cyanine dyes and azo dyes. Among these, oxonole dyes, hemioxonole dyes and merocyanine dyes are particularly suitable.

Suitable white toners are described e.g. in Research Disclosure, December 1978, page 22 et sec., number 17643, chapter V.

Certain layers of binder, in particular those furthest removed from the layer support but occasionally also interlayers, especially when they are furthest removed from the support at some stage during their preparation, may contain photographically inert particles of an inorganic or organic nature, e.g. as matting agents or spacers (DE-A 3 331 542, DE-A 3 424 893, Research Disclosure December 1978, page 22 et sec., Report 17643, chapter XVI).

The average particle diameter of the spacers is mainly in the range of from 0.2 to 10 μm. The spacers are insoluble in water and may be insoluble or soluble in alkalis. Those that are soluble in alkalis are generally removed from the photographic material in the alkaline developer bath. Examples of suitable polymers include polymethyl methacrylate, copolymers of acrylic acid and methyl methacrylate and hydroxypropyl methylcellulose hexahydrophthalate.

The materials according to the invention, which may be black and white or colour photographic or negative, direct positive or reversal materials, are worked up by the usual processes recommended for such materials.

The compounds according to the invention are prepared in the usual manner by an acid or alkaline catalysed reaction of a trihydric to hexahydric alcohol with propylene oxide (Ullmann, Enzyklopadie der techn. Chemie, Urban/SchwarzenbergVerlag 1963, volume 14, page 49 et sec.).

Test Methods

1. Determination of the melting point of gelatine-containing layers.

A sample of the support is dipped in a 0.7% by weight solution of the dye Rose Bengal Temperature of the solution: 6° C.

Movement: gentle stirring.

The solution is slowly heated (1° C. per minute) and the sample is lifted every minute and lightly brushed with a fine artist's paint brush. If white stripes appear due to the removal of gelatine layer, especially in the substrate layer, then the end melting point has been reached.

This method is satisfactory for melting points below 15° C. At higher melting points, the layer is liable to undergo sol/gel conversion due to the long residence time in water so that accurate differentiation of melting points above 20° C. is difficult.

2. Determination of the sol/gel ratios in a sample equipped with an adhesive layer.

This method is based on the fact that a gelatine having a melting point above 20° C. will no longer dissolve in water at 20° C. and a sol gelatine will no longer change into the gel form at 20° C. but dissolves instantly. The gelatine is coloured with the dye Rose Bengal. The intensity of the colour is a measure of the quantity of gel form in the layer.

A sample of the support is half dipped in tap water.

Temperature: 20° C.:25° C.

Stirrer: magnetic stirrer, about 3 revs. per min.

Time: 3 min.

The sample is then coloured with a 1% by weight solution of Rose Bengal for 1 minute at 6° C., washed twice in cold water (6° C.) and dried. The part which has been treated with water at 20° C. and 25° C. either shows no colour (presence of sol form) or a more or less pronounced colour compared with the untreated part of the sample. The colour may be measured in a Macbeth Densitometer behind a green filter and gives the ratio of treated to untreated sample in percent.

3. Test for uniformity.

A light sensitive silver halide emulsion containing a yellow coupler, a light sensitive silver halide emulsion containing a magenta coupler, an interlayer containing a UV absorbent, a light sensitive silver halide emulsion layer containing a cyan coupler and a protective layer containing a hardener are cast successively in that order on a polyethylene coated paper which is covered with a substrate layer.

To assess the casting quality, large areas of colour are exposed to reflected light at D=0.6 behind extraction filters (red, green, blue). A colour area is defined as being uniform when no colour density differences occur within this area. The density differences manifest themselves mainly in stripes and marbling structures.

EXAMPLES

1. Technological conditions for casting the substrate layer.

Speed of machine: 115 m/min
Wet application (roller system): 3.0 g/m$^2$
Dry application: 80 to 300 mg/m$^2$, according to instructions
Drying time: 3.5–7 sec.
Drier: 7 meters drying path
Quantity of air: 25,000 m$^3$/h
Air velocity: about 50 m/sec.
Temperature of material: 45° to 60° C.
Casting temperature: 40° C.

2. General method of preparation of the casting solutions for the substrate layer.

The compounds according to the invention are mixed with a 10% by weight solution of sulpho succinic acid-bis-(2-ethylhexyl)-ester as wetting agent with gentle stirring and the mixture is then added to desalted water. Gelatine is introduced in a solid form, left to swell for 20 minutes at 20° C. and then dissolved at 40° C. Isopropanol and the hardener are then added. The solutions are cast on polyethylene layers which have previously been exposed to corona irradiation.

3. Individual experiments (high gelatine content)

3.1 Comparison experiment.

| | |
|---|---|
| Desalted water | 81.4 l |
| Gelatine | 10 kg |
| Sulpho succinic acid dioctyl ester (10% by weight aqueous solution) | 0.25 kg |
| Isopropanol | 8.0 kg |
| Chrome alum (10% by weight aqueous solution) | 0.35 kg |
| Results: M.p.: 11° C. gel content: 0% | |

Direct casting: vigorous movement in the coloured areas, raster structures, no wet adherence, detachment of the layer.

3.2 According to the invention.

| | |
|---|---|
| Desalted water | 81.48 l |
| Compound 14 | 2.5 kg |
| Sulpho succinic acid dioctyl ester (10% by weight aqueous solution) | 0.250 kg |
| Gelatine | 7.5 kg |
| Isopropanol | 8.0 kg |
| Chrome alum (10% weight aqueous solution) | 0.270 kg |
| Results: m.p.: 28° C. gel content: 60% | |

Direct casting: smooth colour areas, good wet adherence.

3.3 According to the invention.

| | |
|---|---|
| Desalted water | 81.42 l |
| Compound 14 | 3.4 kg |
| Sulpho succinic acid dioctyl ester (10% by weight aqueous solution) | 0.340 kg |
| Gelatine | 6.6 kg |
| Isopropanol | 8.0 kg |
| Chrome alum (10% by weight aqueous solution) | 0.240 kg |
| Results: m.p.: 30° C. gel content: 85% | |

Direct casting: uniform colour areas, good wet adherence.

3.4 According to the invention.

| | |
|---|---|
| Desalted water | 81.32 l |
| Compound 35 | 5.0 kg |
| Sulpho succinic acid dioctyl ester (10% by weight aqueous solution) | 0.5 kg |
| Gelatine | 5.0 kg |
| Isopropanol | 8.0 kg |
| Chrome alum (10% by weight aqueous solution) | 0.180 kg |
| Results: m.p.: 30° C. gel content: 90% | |

Direct casting: uniform colour areas, good wet adherence.

3.5 According to the invention.

| | |
|---|---|
| Desalted water | 74.0 l |
| Compound 6 | 3.5 kg |
| Sulpho succinic acid dioctyl ester (10% by weight aqueous solution) | 0.350 kg |
| Gelatine | 4.0 kg |
| Polyvinylpyrrolidone (5% by weight aqueous solution) | 10.0 kg |
| Isopropanol | 8.0 kg |
| Chrome alum (10% by weight aqueous solution) | 0.150 kg |
| Results: m.p.: 29° C. gel content: 80% | |

Direct casting: uniform colour areas, good wet adherence.

3.6 According to the invention.

| | |
|---|---|
| Desalted water | 74 l |
| Compound 23 | 3.5 kg |
| Sulpho succinic acid dioctyl ester (10% by weight aqueous solution) | 0.350 kg |
| Gelatine | 4.0 kg |
| Copolymer of vinylpyrrolidone/vinyl acetate (7:3) (5% aqueous solution) | 10.0 kg |
| Isopropanol | 8.0 kg |
| Chrome alum (10% by weight aqueous solution) | 0.150 kg |
| Results: m.p.: 29° C. gel content: 86% | |

Direct casting: uniform colour areas, good wet adherence.

3.7 According to the invention.

| | |
|---|---|
| Desalted water | 81.42 l |
| Compound 39 | 3.4 kg |

-continued

| | |
|---|---|
| Sulpho succinic acid dioctyl ester (10% by weight aqueous solution) | 0.340 kg |
| Gelatine | 6.6 kg |
| Isopropanol | 8.0 kg |
| Chrome alum (10% by weight aqueous solution) | 0.240 kg |
| Results: m.p.: 30° C. gel content: 80% | |

Direct casting: uniform colour areas, good wet adherence.

3.8 According to the invention.

| | |
|---|---|
| Desalted water | 81.66 l |
| Compound 30 | 3.4 kg |
| Sulpho succinic acid dioctyl ester (10% by weight aqueous solution) | 0.340 kg |
| Gelatine | 6.6 kg |
| Isopropanol | 8.0 kg |
| Results: m.p.: 28° C. gel content: 82% | |

Direct casting: uniform colour areas, good wet adherence.

3.9 According to the invention.

| | |
|---|---|
| Desalted water | 81.42 l |
| Compound 13 | 2.4 kg |
| Compound 19 | 1.0 kg |
| Sulpho succinic acid dioctyl ester (10% by weight aqueous solution) | 0.340 kg |
| Gelatine | 6.6 kg |
| Isopropanol | 8.0 kg |
| Chrome alum (10% by weight aqueous solution) | 0.240 kg |
| Results: m.p.: 30° C. gel content: 87% | |

Direct casting: uniform colour areas, good wet adherence.

The following experimental table shows the results at different drying temperatures.

Experimental Table

| | Melting point of layer/bond strength | | |
|---|---|---|---|
| | Drying at 45° C. | Drying at 55° C. | Drying at 60° C. |
| Prototype without additive | <10° C. Adherence: − Casting: poor | <10° C. Adherence: − Casting: poor | <10° C. Adherence: − Casting: poor |
| Gelatine + Cpd. 14 (33%) | 30° C. Adherence: + Casting: good | 30° C. Adherence: + Casting: good | 27° C. Adherence: + Casting: good |
| Gelatine + Cpd. 6 (33%) | 29° C. Adherence: + Casting: good | 29° C. Adherence: + Casting: good | 26° C. Adherence: + Casting: good |
| Gelatine + Cpd. 23 (33%) | 29° C. Adherence: + Casting: good | 29° C. Adherence: + Casting: good | 28° C. Adherence: + Casting: good |
| Gelatine + Cpd. 39 (33%) | 30° C. Adherence: + Casting: good | 30° C. Adherence: + Casting: good | 29° C. Adherence: + Casting: good |
| Gelatine + Cpd. 30 (33%) | 28° C. Adherence: + Casting: good | 29° C. Adherence: + Casting: good | 27° C. Adherence: + Casting: good |
| Gelatine + Cpd. 3 (33%) | 30° C. Adherence: + Casting: good | 30° C. Adherence: + Casting: good | 28° C. Adherence: + Casting: good |
| Gelatine + Cpd. 28 (33%) | 28° C. Adherence: + Casting: good | 29° C. Adherence: + Casting: good | 26° C. Adherence: + Casting: good |
| Gelatine + Cpd. 13 (33%) | 30° C. Adherence: + Casting: good | 30° C. Adherence: + Casting: good | 29° C. Adherence: + Casting: good |
| Gelatine + Cpd. 35 (33%) | 29° C. Adherence: + Casting: good | 29° C. Adherence: + Casting: good | 27° C. Adherence: + Casting: good |
| Gelatine + Cpd. 12 (33%) | 30° C. Adherence: + Casting: good | 30° C. Adherence: + Casting: good | 29° C. Adherence: + Casting: good |

M.p. determined 30 minutes after casting (sealed off from air)

4. Individual experiments (low gelatine content)

| | |
|---|---|
| Desalted water | 89.06 l |
| Gelatine | 2.67 kg |
| Sulpho succinic acid dioctyl ester (10% by weight aqueous solution) | 0.270 kg |
| Isopropanol | 8.0 kg |

Direct casting: wide fluctuations in density in the coloured areas, no wet adherence, detachment of the layer.

4.2 According to the invention.

| | |
|---|---|
| Desalted water | 89.07 kg |
| Compound 14 | 1.76 kg |
| Sulpho succinic acid dioctyl ester (10% by weight aqueous solution) | 0.260 kg |
| Gelatine | 0.91 kg |
| Isopropanol | 8.0 kg |

Direct casting: uniform colour areas, wet adherence after 3 to 4 days.

4.3 According to the invention.

| | |
|---|---|
| Desalted water | 89.03 kg |
| Compound 14 | 2.0 kg |
| Sulpho succinic acid dioctyl ester (10% by weight aqueous solution) | 0.300 kg |
| Gelatine | 0.67 kg |
| Isopropanol | 8.0 kg |

Direct casting: uniform colour areas, wet adherence after 3 to 4 days.

4.4 According to the invention.

| | |
|---|---|
| Desalted water | 88.9 kg |
| Compound 14 | 2.14 kg |
| Sulpho succinic acid dioctyl ester (10% by weight aqueous solution) | 0.430 kg |
| Gelatine | 0.53 kg |
| Isopropanol | 8.0 kg |

Direct casting: smooth colour areas, wet adherence after 3 to 4 days.

5. Individual experiments (free from gelatine)

| | |
|---|---|
| 5.1 Comparison sample: PE support, corona irradiated. | |
| 5.2 Desalted water | 88.78 l |
| Compound 14 | 2.67 kg |
| Sulpho succinic acid dioctyl ester (10% by weight aqueous solution) | 0.550 kg |
| Isopropanol | 8.0 kg |

Results after direct casting: more uniform in colour areas than pure PE. Specific surface resistance $1\times10^{10}$ Ω/cm (pure PE > $10^{-}$Ω/cm)

| | | |
|---|---|---|
| 5.3 | Desalted water | 88.78 l |
| | Compound 7 | 2.67 kg |
| | Sulpho succinic acid dioctyl ester (10% by weight aqueous solution) | 0.550 kg |
| | Isopropanol | 8.0 kg |

Results as in 5.2.

| | | |
|---|---|---|
| 5.4 | Desalted water | 77.78 l |
| | Compound 23 | 1.67 kg |
| | Polystyrene sulphonic acid sodium (5%) | 20.0 kg |
| | Sulpho succinic acid dioctyl ester (10% by weight aqueous solution) | 0.550 kg |

Results after direct casting: smoother in colour areas than pure PE. Specific surface resistance $5\times10^{9}$ Ω/cm.

| | | |
|---|---|---|
| 5.5 | Desalted water | 77.78 l |
| | Compound 5 | 1.67 kg |
| | Polystyrene sulphonic acid sodium (5%) | 20.0 kg |
| | Sulpho succinic acid dioctyl ester (10% by weight aqueous solution) | 0.550 kg |

As in 5.4. Specific surface resistance $6.5\times10^{9}$ Ω/cm.

| | | |
|---|---|---|
| 5.6 | Desalted water | 84.05 l |
| | Compound 14 | 2 kg |
| | Polystyrene sulphonic acid sodium (5% by weight aqueous solution) | 13.4 kg |
| | Sulpho succinic acid dioctyl ester (10% by weight aqueous solution) | 0.550 kg |

As in 5.4. Specific surface resistance $8\times10^{9}$ Ω/cm.

The adherence is determined with a colour layer or an arrangement of colour layers two hours after casting.

6. Experiments with NC (non-curling) layers

Technical conditions:

Drying: floating dryer as under 1

Speed of machine: 60 m/min

Drying time: 25 sec.

Temperature of material after drying: 50° C.

6.1 Comparison experiment

| | |
|---|---|
| Deslated water | 74.8 l |
| Gelatine | 10.0 kg |
| Sulpho succinic acid dioctyl ester (10% by weight aqueous solution) | 0.5 kg |
| Isopropanol | 8.0 kg |
| Triacryloformal (3% by weight aqueous solution) | 6.7 kg |
| pH 6.8 | |

Time up to melting point 100° C.: 5 weeks.

6.2 According to the invention.

| | |
|---|---|
| Deslated water | 85.1 l |
| Compound 14 | 3.4 kg |
| Gelatine | 6.6 kg |
| Sulpho succinic acid dioctyl ester (10% by weight aqueous solution) | 0.5 kg |
| Triacryloformal (3% by weight aqueous solution) | 4.4 kg |
| pH 6.8 | |

Time up to melting point 100° C.: 4 days.

7. Experiments with instant hardener of the following formula:

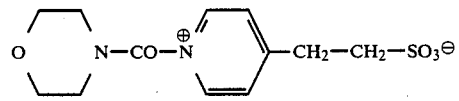

7.1 Comparison.

Total arrangement of layers of colour photographic paper with a typical uppermost protective layer. Hardening of the complete set of layers with 3% by weight of the instant hardener mentioned above.

Wet scratch strength: 2.5N 7.2 Experiment as in 7.1 but with 33% by weight of the top layer of gelatine replaced by compound 6.

Wet scratch strength: 4.5N

What is claimed is:

1. Photographic material containing at least one auxiliary layer and at least one light sensitive emulsion layer, characterised in that the auxiliary layer contains at least one compound which has been obtained by the reaction of a trihydric to hexahydric alcohol with propylene oxide and has an OH content of from 7 to 15% by weight.

2. Photographic material according to claim 1, characterised in that the reaction products have an OH content of from 9.5 to 12.5% by weight.

3. Photographic material according to claim 1, characterised in that the tri- to hexahydric alcohols contain 3 to 6 carbon atoms.

4. Photographic material according to claim 1, characterised in that the reaction products are used together with gelatine in a ratio by weight of from 0.1:1 to 10:1.

5. Photographic material according to claim 4, characterised in that the gelatine is partly replaced by other high molecular weight, water soluble polymers.

6. Polyethylene coated paper containing a substrate layer and at least one light sensitive silver halide emulsion layer, characterised in that the substrate layer contains at least one compound which has been obtained by the reaction of a trihydric to hexahydric alcohol with propylene oxide and has an OH content of from 7 to 15% by weight.

* * * * *